US005382135A

United States Patent [19]

Green

[11] Patent Number: 5,382,135

[45] Date of Patent: Jan. 17, 1995

[54] ROTOR BLADE WITH COOLED INTEGRAL PLATFORM

[75] Inventor: Dennis J. Green, Amston, Conn.

[73] Assignee: United Technologies Corporation, Hartford, Conn.

[21] Appl. No.: 139,625

[22] Filed: Oct. 20, 1993

Related U.S. Application Data

[63] Continuation of Ser. No. 980,850, Nov. 24, 1992, abandoned.

[51] Int. Cl.[6] ..... F01D 5/18

[52] U.S. Cl. ..... 416/97 R; 415/115

[58] Field of Search ..... 415/115, 116, 914; 416/95, 96 R, 96 A, 97 R

[56] References Cited

U.S. PATENT DOCUMENTS

| | | | |
|---|---|---|---|
| 2,737,366 | 3/1956 | Ledinegg . | |
| 3,066,910 | 12/1962 | Bluck . | |
| 3,446,481 | 5/1969 | Kydd . | |
| 3,446,482 | 5/1969 | Kydd . | |
| 4,017,213 | 4/1977 | Przirembel . | |
| 4,040,767 | 8/1977 | Dierberger et al. | 415/115 |
| 4,137,619 | 2/1979 | Beltran et al. | 416/95 |
| 4,672,727 | 6/1987 | Field . | |
| 4,676,719 | 6/1987 | Auxier et al. | 416/97 R |
| 4,946,346 | 8/1990 | Ito | 416/97 R |
| 5,096,379 | 3/1992 | Stroud et al. | 416/97 R |
| 5,122,033 | 6/1992 | Paul . | |

FOREIGN PATENT DOCUMENTS

| | | |
|---|---|---|
| 742288 | 2/1952 | United Kingdom . |
| 2070147 | 2/1981 | United Kingdom . |

*Primary Examiner*—John T. Kwon
*Assistant Examiner*—Christopher Verdier

[57] ABSTRACT

A rotor blade having a cooled integral platform is disclosed. Various construction details are developed which disclose a rotor blade platform having a first cooling hole for directing rotor blade core cooling fluid over a first portion of the platform and a second cooling hole for directing under-platform cavity cooling fluid over a second portion of the platform. In a particular embodiment, a rotor blade platform includes a plurality of first cooling holes and a plurality of second cooling holes. The first cooling holes extend between a core cooling passage within the blade and the platform outer surface. The second cooling holes extend between a damper cavity and the platform outer surface. Both sets of cooling holes are oriented to direct a film of cooling fluid over the platform outer surface and individual cooling holes are aligned with flow streamlines of an interblade vortices to encourage the development of a film of cooling fluid.

14 Claims, 4 Drawing Sheets

ROTOR BLADE WITH COOLED INTEGRAL PLATFORM

This is a Continuation Application under 37 CFR 1.62 of prior application Ser. No. 07/980,850 filed on Nov. 24, 1992, now abandoned.

TECHNICAL FIELD

This invention relates to gas turbine engines, and more particularly to rotor blades having integral platforms.

BACKGROUND OF THE INVENTION

A typical gas turbine engine has an annular axially extending flow path for conducting working fluid sequentially through a compressor section, a combustion section, and a turbine section. The compressor section includes a plurality of rotating blades which add energy to the working fluid. The working fluid exits the compressor section and enters the combustion section. Fuel is mixed with the compressed working fluid and the mixture is ignited to add more energy to the working fluid. The resulting products of combustion are then expanded through the turbine section. The turbine section includes another plurality of rotating blades which extract energy from the expanding fluid. A portion of this extracted energy is transferred back to the compressor section via a rotor shaft interconnecting the compressor section and turbine section. The remainder of the energy extracted may be used for other functions.

Recent gas turbine engine development has resulted in rotor blades having more effective and efficient interaction with fluid flowing in the flow path. This has resulted in fewer rotor blades per disk and a lighter rotor assembly. As a consequence of having fewer rotor blades per disk, the spacing between adjacent rotor blades has increased.

Each of the rotor blades includes an airfoil portion, a root portion, and a platform. The airfoil portion extends through the flow path and interacts with working fluid to transfer energy between the rotor blade and working fluid. The root portion engages the attachment means of the disk. The platform typically extends laterally from the rotor blade to a platform of an adjacent rotor blade. The platform is disposed radially between the airfoil portion and the root portion. The platform includes a radially outward facing flow surface. The plurality of platforms extends circumferentially about the longitudinal axis of the gas turbine engine to define a radially inner flow surface for working fluid. This inner flow surface confines working fluid to the airfoil portion of the rotor blade.

Platforms are generally of two types. The first is a chevron type which includes lateral edges curved to approximate the airfoil shape of the rotor blade. This type of shape minimizes the lateral extension of the platform from the rotor blade. Minimizing the lateral extension, or cantilevered portion of the platform, minimizes the rotationally caused bending stress in the platform.

The second type of platform includes parallel lateral edges which extend linearly in an axial orientation. Parallel edges provide for ease of manufacture of the rotor blades and ease of installation onto the disk. However, the parallel lateral edges result in platforms which extend further outward from the blade. The lateral extension of the platform becomes more significant as the spacing between adjacent rotor blades increases. The combination of parallel, linear edges and increased rotor blade spacing results in a platform having a significant cantilever.

As a result of the lateral extension, this type of platform has higher bending stress than a comparable chevron platform. The bending stress is particularly significant in the region of the attachment of the platform to the root portion and airfoil portion of the rotor blade. To accommodate this stress, the parallel edged platform is typically made thicker, in the radial dimension, with a lateral taper. Increasing the thickness of the platform adds to the bulk of the blade and adversely affects operating efficiency of the gas turbine engine.

Another concern associated with the parallel edged platforms is the overheating of the platforms. The laterally outermost portion of the platforms receive little cooling from the core cooling fluid passing through the rotor blade. Therefore this portion of the platform is subject to degradation as a result of overheating. Degradation of the platform reduces the effectiveness of the platform to confine the flow of working fluid to the airfoil portion of the blade and thereby causes a reduction in operational efficiency of the gas turbine engine.

A solution to the overheating of the platform is to provide cooling fluid to the platform. Typically this involves having cooling holes pass radially through the platform to a damper cavity located underneath the platform. The damper cavity contains cooling fluid which has passed through various passages within the rotor assembly to provide cooling to the rotor assembly. This cooling fluid then passes out through the cooling holes and cools the platform in the vicinity of the cooling holes.

A problem associated with cooling holes of this type has been to properly locate them. Due to pressure fluctuations over the surface of the platform, the pressure differential between the damper cavity and the flow path fluctuates along the surface of the platform. This may lead to a negative pressure differential near the cooling hole and may cause ingestion of working fluid through the cooling hole and into the damper cavity. Within the damper cavity the ingested working fluid heats up the cavity and may cause degradation to nearby structure, including the platform, the damper, and the disk attachment area. In addition, non-gaseous products in the working fluid may block the cooling holes and reduce or prevent cooling fluid from exiting the damper cavity, thereby blocking cooling fluid from flowing over the flow surface of the platform.

The above art notwithstanding, scientists and engineers under the direction of Applicants' Assignee are working to develop effective cooling means for rotor blade platforms.

DISCLOSURE OF THE INVENTION

The present invention was predicated in part upon the recognition that flow through a circumferentially spaced array of rotor blades generates flow vortices between airfoil portions of adjacent rotor blades, hereinafter referred to as interblade vortices. As the spacing between adjacent rotor blades increases, the strength of each of these interblade vortices. The interblade vortices rotate about an axially oriented axis and generate flow directed radially inward along the pressure surface side of the airfoil portions and radially outward along the suction side of the airfoil portions. This non-axially directed flow creates a pressure fluctuation along the surface of the platform such that higher pressure regions exist near the junction of the pressure surface side of the airfoil portion and the platform than at the laterally outer edges of the platform.

According to the present invention, a rotor blade includes a platform having a first cooling hole extending between a core cooling passage and the platform and a second cooling hole extending between an under-platform cavity and the platform. The first cooling hole provides a film of cooling fluid over the region of the platform nearest the airfoil portion of the blade. The second cooling hole provides a film of cooling fluid over the laterally outermost region of the platform.

According further to the present invention, each of the cooling holes includes an exit disposed on the surface of the platform and a flow directed axis, wherein the cooling hole axis is aligned with a streamline of the interblade vortices in the vicinity of the exit.

According to a specific embodiment of the present invention, a turbine rotor blade assembly includes a disk and a plurality of circumferentially spaced, hollow rotor blades, the rotor blades being in communication with a source of cooling fluid and including an airfoil portion, a root portion, and a platform having a first cooling hole in communication with the cooling fluid flowing through the rotor blade and a second cooling hole in communication with cooling fluid within a damper cavity between adjacent rotor blades. The cooling holes are disposed in the pressure surface side of the platform and have longitudinal axes which are aligned with a flow streamline of the interblade vortices over the exit of the cooling holes. The first cooling hole provides high pressure cooling fluid which, upon exiting the cooling holes, is directed over the surface of the platform near the junction of the platform and airfoil portion. The second cooling hole provides cooling fluid at a lower pressure than the first cooling hole but which is directed over the surface of the laterally outermost portion of the platform.

A principle feature of the present invention is the two types of cooling holes in the platform, one in communication with the core cooling fluid and the other in communication with under-platform cooling fluid. Another feature is the location of the cooling holes with the first cooling hole nearest the airfoil portion and the second cooling hole laterally outward of the first. A further feature is the alignment of the cooling holes with the flow streamlines of the interblade vortices. A still further feature is the directionality of the cooling holes relative to the surface of the platform.

A primary advantage of the present invention is the effective cooling of the platform as a result of the cooling scheme. The first cooling hole provides high pressure cooling fluid in the region where the interblade vortices causes flow path pressure to be highest. The second cooling hole provides lower pressure cooling fluid in a region where flow path pressure is lower. Another advantage of the present invention is the effective use of the cooling fluid exiting the cooling holes as a result of the alignment and directionality of the cooling holes. The cooling fluid exiting the cooling holes is directed at an acute angle relative to the surface of the platform to encourage the cooling fluid to form a film over the surface. In addition, engagement of the interblade vortices flow also encourages the exiting cooling fluid to form a film of cooling fluid over the platform surface.

The foregoing and other objects, features and advantages of the present invention become more apparent in light of the following detailed description of the exemplary embodiments thereof, as illustrated in the accompanying drawings.

BEST MODE FOR CARRYING OUT THE INVENTION

Figure 1:
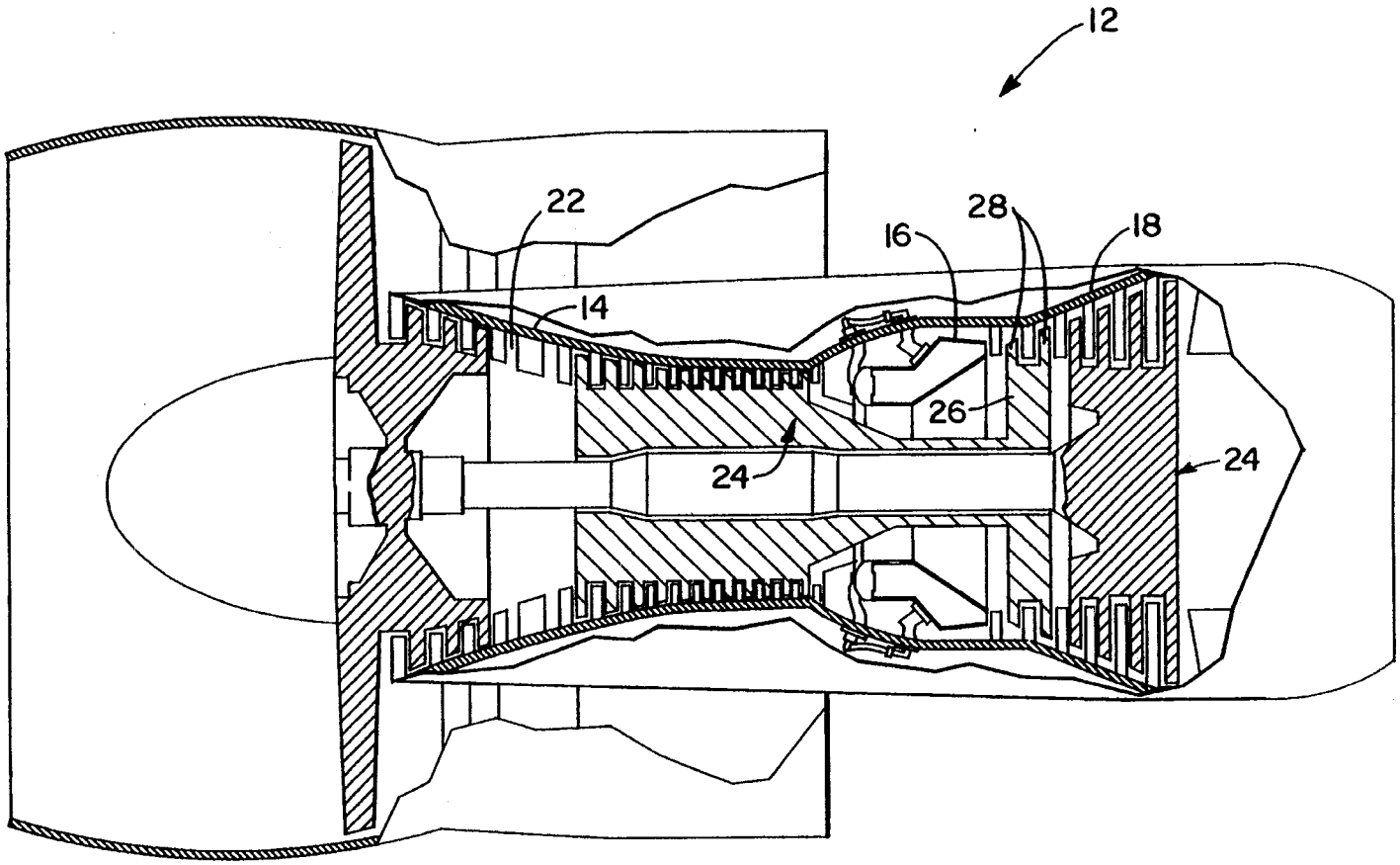
FIG. 1 is a cross sectional side view of a gas turbine engine.

FIG. 1 illustrates a typical axial flow gas turbine engine 12. The gas turbine engine includes a compressor section 14, a combustor 16, and a turbine section 18. A flow path 22 extends axially through the gas turbine engine and defines a passage for working fluid to pass sequentially through the compressor section, the combustor and the turbine section.

Figure 2:
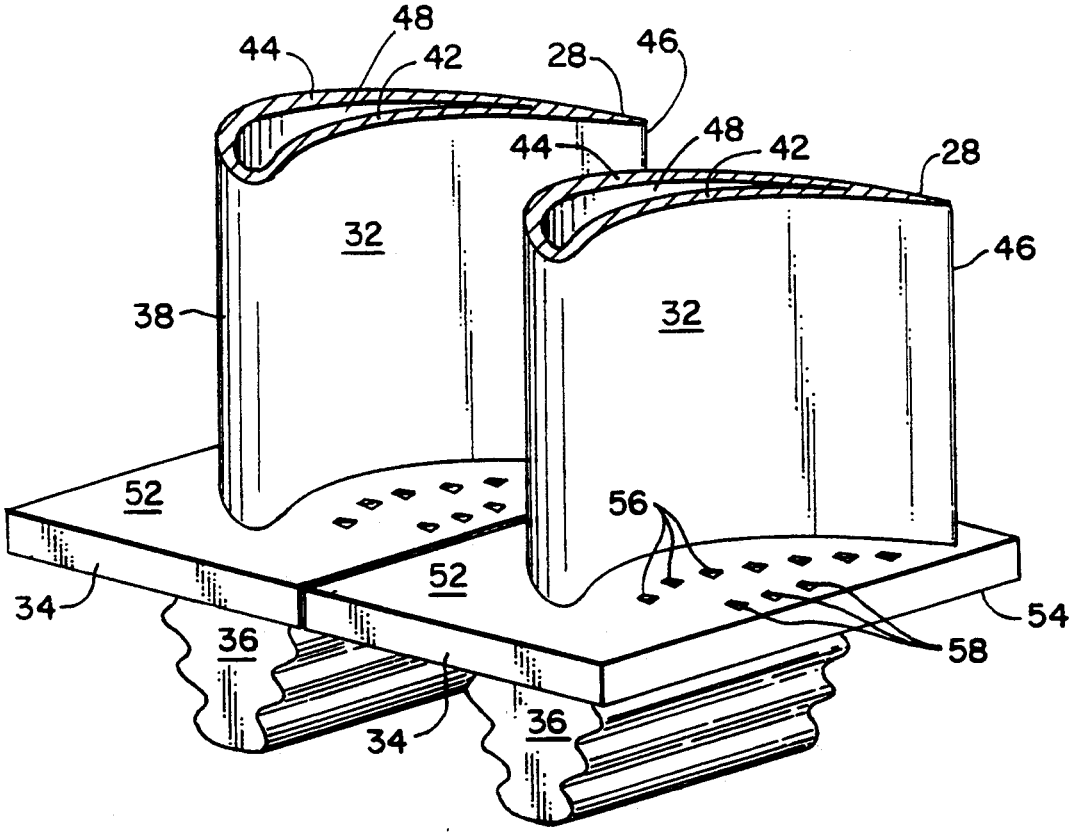
FIG. 2 is a perspective view of adjacent rotor blades with other rotor assembly structure removed for clarity.

The turbine section includes a plurality of rotor assemblies 24, each rotor assembly including a rotatable disk 26 and a plurality of circumferentially spaced rotor blades 28 extending radially from the disk. As shown in FIG. 2, each rotor blade includes an airfoil portion 32 which extends through the flow path, an integral platform 34 which extends laterally about the rotor blade and a root portion 36 which engages the disk to retain the rotor blade to the disk. The airfoil portion includes a leading edge 38, a pressure surface 42, a suction surface 44, and a trailing edge 46. The airfoil portion is hollow and is within fluid communication with cooling passages 48 through the root portion. The cooling passages of the root portion are in fluid communication with a source of high pressure cooling fluid, typically a supply of compressor air which bypasses the combustion process. The cooling fluid within the airfoil section is typically expelled through cooling holes which extend between the hollow air portion and the flow path.

The platform includes an outer surface 52 which extends laterally to be in close proximity to the platform of an adjacent rotor blade. The plurality of platforms and their outer surfaces define a radially inner flow surface for working fluid within the flow path. In this way the platforms confine the working medium to the airfoil portion of the rotor blade to maximize the interaction between the airfoil portion and the working fluid and the efficiency of the energy transfer between the working fluid and the airfoil portion. The platform also includes an underside 54, a plurality of first cooling holes 56, and a plurality of second cooling holes 58. The underside of the platforms defines in part a damper cavity 62 (see FIG. 4) between adjacent rotor blade root portions. The damper cavity typically retains vibration damping means to minimize the vibration of the rotor blade during operation.

Figure 3:
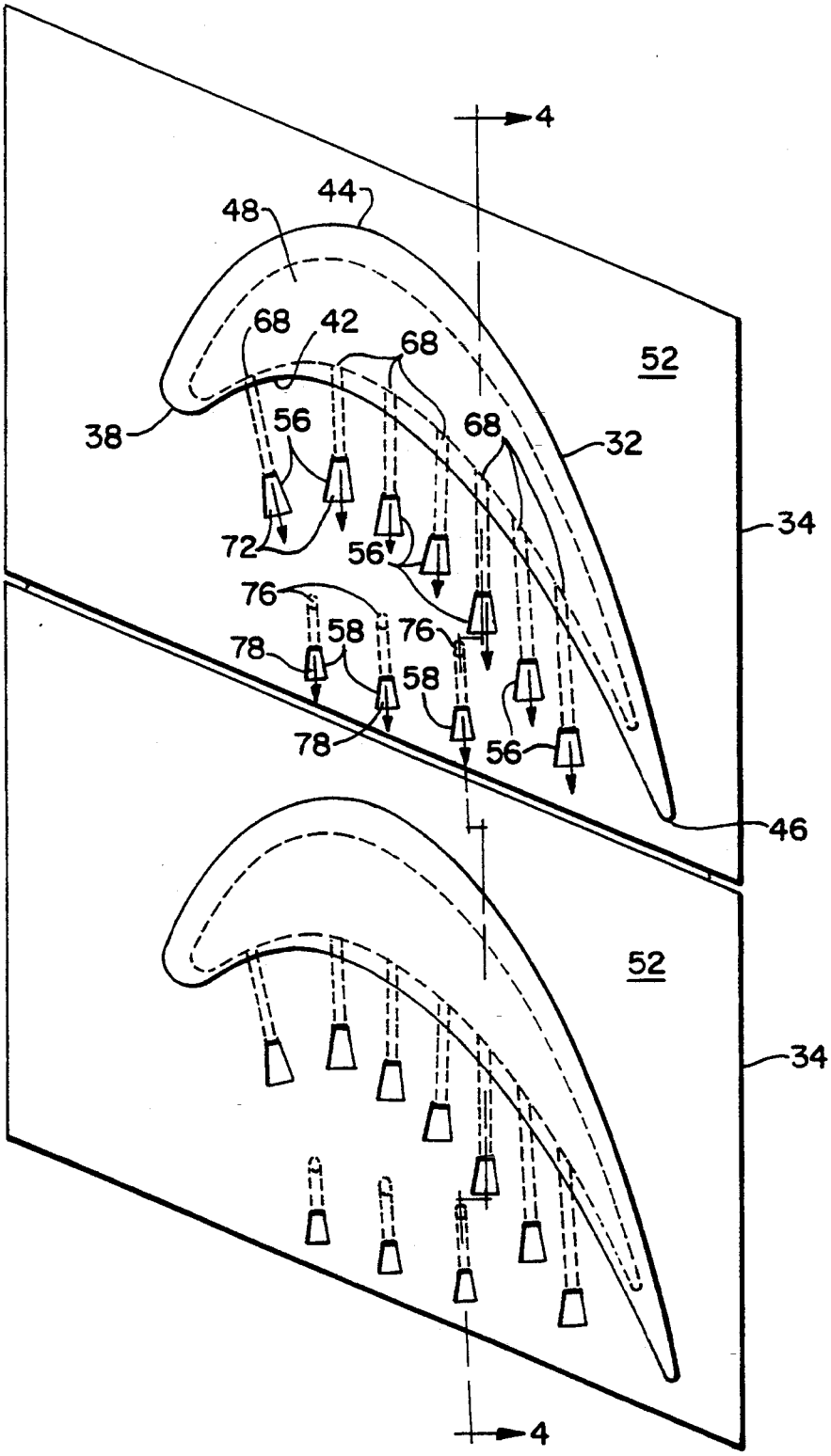
FIG. 3 is a top view of the adjacent pair of rotor blades with the cooling holes shown by dashed lines.
Figure 4:
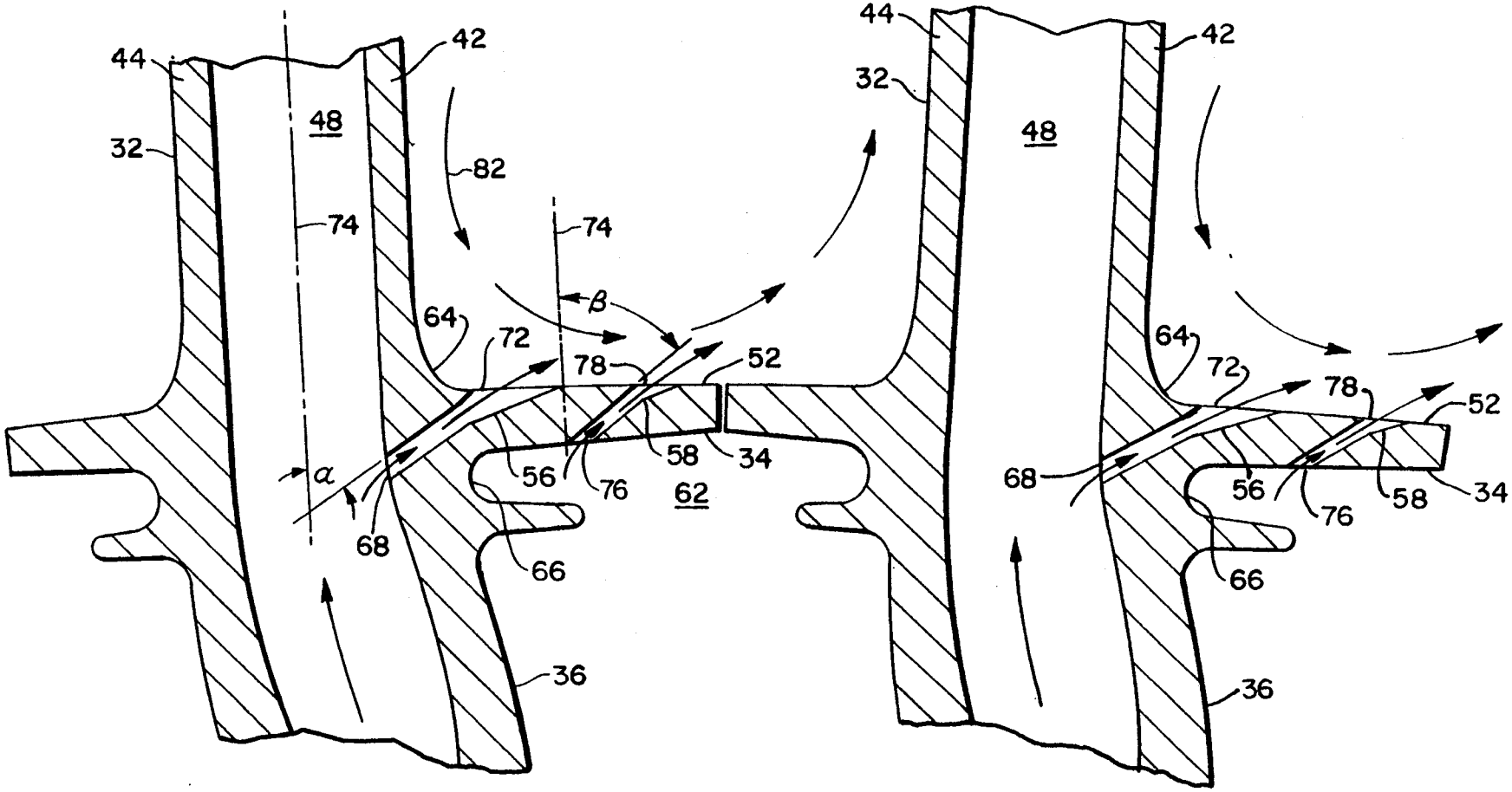
FIG. 4 is a view taken along line 4—4 of FIG. 3 with arrows indicating the flow of cooling fluid and the interblade vortices.

The plurality of first cooling holes extend along the pressure surface of the airfoil from the leading edge to the trailing edge. This set of cooling holes approximates the shape of the pressure surface of the airfoil, as shown in FIGS. 3 and 4. Each of the first cooling holes extends between a core cooling passage and the platform outer surface and is disposed radially between the platform-to airfoil-fillet 64 and a platform-to-root fillet 66. The first cooling hole includes an inlet 68 which provides means of fluid communication between the core passage and the cooling hole and an outlet 72 which provides means of communication between the cooling hole and the flow path. Each of the first cooling holes is angled relative to the radial axis 74 such that cooling fluid is directed radially outward and laterally away from the pressure surface of the airfoil. The outlet of each of the first cooling holes is shaped to provide diffusion of the cooling fluid exiting the first cooling hole. Diffusing the exiting cooling fluid spreads the cooling fluid over a greater area and lowers the flow velocity of the cooling fluid. Lowering the velocity increases the likelihood that the cooling fluid will not separate from the surface and will form a film over the surface.

The plurality of second cooling holes extend between the damper cavity and the platform outer surface and include an inlet 76 providing fluid communication between the second cooling hole and the damper cavity and an outlet 78 providing fluid communication through the cooling hole and the flow path. Each of the second cooling holes is disposed along the laterally outward portion of the pressure side platform. The second cooling holes are also angled relative to the radial axis to direct cooling fluid radially outward and laterally away from the pressure surface of the airfoil portion. The exits of each of the second cooling holes is also shaped to provide means of diffusing the cooling fluid exiting the second cooling holes.

As shown in FIGS. 3 and 4, an interblade vortice 82 extends between the adjacent blades and rotates about an axially oriented axis. The vortice is represented as a plurality of flow stream lines which indicate the direction of flow within the vortices. This vortice carries fluid radially inward along the pressure surface of each blade, then laterally between the pressure surface and the suction surface of an adjacent blade, and then radially outward along the suction surface. The effect of this vortice is to increase the total pressure along the surface of the platform nearest the airfoil pressure surface. The pressure along the outer surface decreases laterally outward from the pressure surface. Each of the first cooling holes and second cooling holes is aligned such that the direction of fluid flow through the cooling holes approximates the lateral direction of flow of the inner blade vortices near the outlet of each cooling hole.

During operation, working fluid passes axially through the rotor blade assembly. Engagement of the working fluid and the plurality of rotor blades generates pressure variations along the outer surface of the platform. As discussed previously, the vortices generate a pressure gradient which decays in a direction laterally outward from the pressure surface of the airfoil. In addition, pressure losses occur as the working fluid passes axially through the rotor blade assembly such that the region of the platform of the outer surface near the leading edge as a high pressure region and the pressure along the outer surface decays axially downstream from the leading edge. The resulting pressure feel along the outer surface has a relatively high pressure region forward of the leading edge and along the pressure surface junction with the outer surface of the platform. A relatively low pressure region exists at the laterally outward edge and at approximately at the mid span of the airfoil portion.

As shown in FIG. 4, core cooling fluid passes radially outward from the root portion towards the airfoil portion. A portion of this core cooling fluid passes through the first cooling hole inlets, along the first cooling holes and out the first cooling hole exits. The core cooling fluid is drawn from the compressor section and is relatively low temperature and relatively high pressure fluid as compared to the working fluid passing through the rotor assembly. This ensures that cooling fluid exiting the first cooling holes will flow radially outward and into the flow path. In addition this provides the coolest fluid in the region of the platform subject to the highest temperatures.

The second cooling holes use the cooling fluid within the damper cavity as a source of cooling fluid. Fluid within the damper cavity consists of cooling fluid from the compressor section which has leaked around various seals and which has followed a tortuous path before flowing into the damper cavity. As such, the cooling fluid within the damper cavity is at a lower pressure and higher temperature than the core cooling fluid. For this reason this cooling fluid may be at too low a pressure to be used as cooling fluid in the higher pressure regions of the platform. Use of this cooling fluid may lead to ingestion of working fluid into the damper cavity and thereby degrade the rotor assembly. The damper cavity cooling fluid, however, may be ejected out into the lower pressure regions of the platform, as shown in FIGS. 2, 3 and 4.

The fluid exiting the first cooling holes and the second cooling holes does so at an angle relative to the radial axis such that is encouraged to flow laterally over the outer surface. In addition, the fluid exiting the first cooling holes and second cooling holes engages the flow within the vortices which further encourages the cooling fluid to flow over the outer surface in a lateral direction between the pressure surface and suction surface. The combination of first cooling holes and second cooling holes as shown in FIGS. 2 and 3 provides a film or blanket of cooling fluid over the pressure surface side of the platform, with the coolest highest pressure fluid being concentrated in the high pressure high temperature region of the platform and with the remaining cooling fluid concentrated in the lower pressure region of the platform. In this way the effectiveness of the platform cooling is optimized in the amount of cooling fluid necessary to cool a platform is thereby minimized.

Although the invention has been shown and described with respect with exemplary embodiments thereof, it should be understood by those skilled in the art that various changes, omissions, and additions may be made thereto, without departing from the spirit and scope of the invention.

What is claimed is:

1. A rotor blade for an axial flow gas turbine engine disposed about a longitudinal axis, the gas turbine engine including an axially directed flow path defining a passage for working fluid, a rotor assembly including a rotatable disk and the rotor blade, and a source of cooling fluid, the rotor blade including:

an airfoil section extending through the flow path, the airfoil portion including a pressure surface and a suction surface, the airfoil portion having a hollow core;

a root portion disposed radially inward of the airfoil portion and engaged with the disk to secure the blade to the disk, the root portion including a core path defining a flow path for cooling fluid, the core path being in fluid communication with the source of cooling fluid and with the hollow core of the airfoil portion;

and a platform extending laterally from the blade and disposed radially between the airfoil portion and the root portion, the platform including an outer surface defining a flow surface for the flow path, a first fillet adjoining the outer surface and the airfoil portion, an inner surface defining in part an under platform cavity, and a second fillet adjoining the inner surface and the root portion; and wherein a first cooling hole extends between the core path and the outer surface, the first cooling hole being disposed radially inward of the first fillet and radially outward of the second fillet, the first cooling hole having an inlet disposed in the core path and an exit disposed on the outer surface and laterally outward of the first fillet, and wherein a second cooling hole extends between the under platform cavity and the outer surface, the second cooling hole including an inlet disposed on the inner surface and an exit disposed on the outer surface, the second cooling hole exit disposed laterally outward of the first cooling hole exit.

2. The rotor blade according to claim 1, wherein the rotor assembly includes a plurality of rotor blades spaced circumferentially about the disk, the spacing being such that an interblade vortex is generated between adjacent blades, the interblade vortex having an axially oriented axis and a plurality of flow streamlines extending between adjacent blades, and wherein the first cooling hole includes a first cooling hole axis oriented in the direction of flow through the first cooling hole, the first cooling hole axis being aligned with one of the flow streamlines, and wherein the second cooling hole includes a second cooling hole axis oriented in the direction of flow through the second cooling hole, the second cooling hole axis being aligned with one of the flow streamlines.

3. The rotor blade according to claim 1, wherein the first cooling hole includes means to diffuse cooling fluid exiting the first cooling hole and wherein the second cooling hole includes means to diffuse cooling fluid exiting the second cooling hole.

4. The rotor blade according to claim 1, wherein the first cooling hole and the second cooling hole are angled to direct cooling fluid radially outward and laterally over the outer surface.

5. The rotor blade according to claim 2, wherein the first cooling hole includes means to diffuse cooling fluid exiting the first cooling hole and wherein the second cooling hole includes means to diffuse cooling fluid exiting the second cooling hole.

6. The rotor blade according to claim 2, wherein the first cooling hole and the second cooling hole are angled to direct cooling fluid radially outward and laterally over the outer surface.

7. The rotor blade according to claim 5, wherein the first cooling hole and the second cooling hole are angled to direct cooling fluid radially outward and laterally over the outer surface.

8. A rotor assembly for a gas turbine engine disposed about a longitudinal axis, the gas turbine engine including an axially directed flowpath defining a passage for working fluid and a source of cooling fluid, the rotor assembly including:

a rotatable disk; and a plurality of rotor blades, wherein each of the plurality of rotor blades includes:

an airfoil section extending through the flow path, the airfoil portion including a pressure surface and a suction surface, the airfoil portion having a hollow core;

a root portion disposed radially inward of the airfoil portion and engaged with the disk to secure the blade to the disk, the root portion including a core path defining a flow path for cooling fluid, the core path being in fluid communication with the source of cooling fluid and with the hollow core of the airfoil portion;

and a platform extending laterally from the blade and disposed radially between the airfoil portion and the root portion, the platform including an outer surface defining a flow surface for the flow path, a first fillet adjoining the outer surface and the airfoil portion, an inner surface defining in part an under platform cavity, and a second fillet adjoining the inner surface and the root portion; and wherein a first cooling hole extends between the core path and the outer surface, the first cooling hole being disposed radially inward of the first fillet and radially outward of the second fillet, the first cooling hole having an inlet disposed in the core path and an exit disposed on the outer surface and laterally outward of the first fillet, and wherein a second cooling hole extends between the under platform cavity and the outer surface, the second cooling hole including an inlet disposed on the inner surface and an exit disposed on the outer surface, the second cooling hole exit disposed laterally outward of the first cooling hole exit.

9. The rotor assembly according to claim 8, wherein the plurality of rotor blades are spaced circumferentially about the disk, the spacing being such that an interblade vortex is generated between adjacent blades, the interblade vortex having an axially oriented axis and a plurality of flow streamlines extending between adjacent blades, and wherein the first cooling hole includes a first cooling hole axis oriented in the direction of flow through the first cooling hole, the first cooling hole axis being aligned with one of the flow streamlines, and wherein the second cooling hole includes a second cooling hole axis oriented in the direction of flow through the second cooling hole, the second cooling hole axis being aligned with one of the flow streamlines.

10. The rotor blade assembly according to claim 8, wherein the first cooling hole includes means to diffuse cooling fluid exiting the first cooling hole and wherein the second cooling hole includes means to diffuse cooling fluid exiting the second cooling hole.

11. The rotor blade assembly according to claim 8, wherein the first cooling hole and the second cooling hole are angled to direct cooling fluid radially outward and laterally over the outer surface.

12. The rotor blade assembly according to claim 9, wherein the first cooling hole includes means to diffuse cooling fluid exiting the first cooling hole and wherein the second cooling hole includes means to diffuse cooling fluid exiting the second cooling hole.

13. The rotor blade assembly according to claim 9, wherein the first cooling hole and the second cooling hole are angled to direct cooling fluid radially outward and laterally over the outer surface.

14. The rotor blade assembly according to claim 12, wherein the first cooling hole and the second cooling hole are angled to direct cooling fluid radially outward and laterally over the outer surface.

* * * * *